US007055726B2

(12) United States Patent
Satoh et al.

(10) Patent No.: US 7,055,726 B2
(45) Date of Patent: Jun. 6, 2006

(54) APPARATUS FOR MODIFYING TRAVELING POSITION OF PAPER WEB IN PAPER WEB PROCESSING MACHINE

(75) Inventors: Atsushi Satoh, Kanagawa (JP); Yoshiki Kunoh, Tokyo (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 278 days.

(21) Appl. No.: 10/327,756

(22) Filed: Dec. 23, 2002

(65) Prior Publication Data

US 2003/0183356 A1 Oct. 2, 2003

(30) Foreign Application Priority Data

Mar. 29, 2002 (JP) ..... 2002-096285

(51) Int. Cl.
*B65H 16/00* (2006.01)

(52) U.S. Cl. ..... 226/20; 242/15; 242/45

(58) Field of Classification Search ..... 226/15, 226/19, 20, 45

See application file for complete search history.

(56) References Cited

U.S. PATENT DOCUMENTS 4,077,579 A 3/1978 Seleski et al.
4,485,952 A * 12/1984 Weis ..... 227/7
4,860,964 A * 8/1989 Ishii et al. ..... 242/534.1
5,087,313 A * 2/1992 Duecker ..... 156/271
5,489,784 A * 2/1996 Koiranen et al. ..... 250/548
5,554,262 A * 9/1996 Turner ..... 162/198
5,783,007 A * 7/1998 Boyd et al. ..... 156/64
5,813,337 A * 9/1998 Peters et al. ..... 101/228
5,901,647 A * 5/1999 Kohlmann ..... 101/216
6,269,995 B1 * 8/2001 Rich et al. ..... 226/17
6,622,625 B1 * 9/2003 Sugiyama ..... 101/484

FOREIGN PATENT DOCUMENTS

JP 58-29087 12/1980
WO WO 92/18968 10/1992

* cited by examiner

*Primary Examiner*—Eileen D. Lillis
*Assistant Examiner*—Evan Langdon
(74) *Attorney, Agent, or Firm*—Trexler, Bushnell, Giangiorgi, Blackstone & Marr, Ltd.

(57) ABSTRACT

An apparatus for modifying a traveling position of a paper web in a paper web processing machine is provided. The apparatus is capable of easily attaching a detection means; requiring no operation of the paper web processing machine to determine an accurately adjusted position for attachment; and extremely easily setting a desired size of a tolerable deviation range of a practical position of a side edge to an originally expected position of the side edge when the sheet travels. The apparatus includes a traveling position modification means for modifying a position of a side edge of a paper web traveling toward a processing section in a paper web processing machine; a detection means for detecting the position of the side edge of the paper web; and a control means connected to the modification means and the detection means for controlling the modification means based on a value detected at the detection means.

9 Claims, 8 Drawing Sheets

APPARATUS FOR MODIFYING TRAVELING POSITION OF PAPER WEB IN PAPER WEB PROCESSING MACHINE

RELATED APPLICATION (FOREIGN PRIORITY CLAIM)

This application claims foreign priority from Japanese Application Serial No. 2002-96285, filed Mar. 29, 2002.

BACKGROUND OF THE INVENTION

1. Field of the Invention

The present invention relates to an apparatus for modifying a traveling position of a paper web in a paper web processing machine. More particularly, it relates to an apparatus for modifying a paper web traveling position, which is capable of automatically modifying a deviation of a web-mounted position in a paper web processing machine such as a rotary press based on a detected value from a position of a side edge of a paper web drawn out from a rolled web. Such the deviation may be caused when the web is mounted on a position and the position is deviated in the axial direction of the web or a width of the paper web relative to a processing section due to a slight difference in inner diameters of the core tube in the web.

2. Description of the Related Art

An apparatus for modifying a traveling position of a paper web is shown as "Side lay device" on page 103, lines 3–20 in "Newspaper Printing Handbook" (issued by (Foundation) Nippon Newspaper Association on Apr. 10, 1997). The device employs a photo-electronic detecting means to detect a side edge of a traveling paper web drawn out from a rolled web. When the side edge of the traveling paper web is not located on an originally expected position, it operates a traveling position modifying means to modify the side edge of the traveling sheet so that it can be located on the originally expected position.

Japanese Utility Model Publication No. 58-29087 shows an example of the apparatus for modifying the traveling position of the paper web, which employs a sheet edge detector. The sheet edge detector is equipped with two sets of reflective photo-electronic detectors corresponding to both sides of a tolerable deviation range (a range that can permit a deviation) within which the side edge of the traveling paper web should be located originally, for example, a range extending each 1 mm to the left and to the right from the reference position. The sheet edge detector is located at a part that corresponds to the tolerable deviation range on the outer circumference of a guide roller that guides the paper web traveling. The outer circumference of the guide roller is colored black to ensure the detection of the light reflected from the white paper web. Based on the detected state of the light reflected from the paper web using the two sets of reflective photo-electronic detectors, it is possible to determine if the traveling position of the paper web falls outside the tolerable deviation range. If the side edge of the traveling paper web falls outside the tolerable deviation range, the apparatus for modifying the traveling position of the paper web is operated to modify the side edge of the traveling paper web to fall inside the tolerable deviation range.

The apparatus for modifying the traveling position of the paper web shown in Japanese Utility Model Publication No. 58-29087 requires the sheet end detector, which is detection means, to be attached precisely to the originally expected position of the paper web end, during the traveling of the paper web, determined relative to the center of the processing section, when the sheet end detector, which is detection means, is attached to the paper web processing machine. Such the attachment is difficult, however, and it requires a considerable experience and skill. In addition, it finally requires a practical operation of the paper web processing machine to obtain an accurately adjusted position for attachment.

The sheet edge detector, which is detection means, is equipped with two sets of reflective photo-electronic detectors each for detecting respective sides of the tolerable deviation range. Therefore, it is difficult to set the tolerable deviation range narrower and also difficult to process when a required accuracy is high on a position to be processed in the sheet width.

SUMMARY OF THE INVENTION

The present invention has an object to provide an apparatus for modifying a paper web traveling position in a paper web processing machine, which is capable of easily attaching a detection means; requiring no operation of the paper web processing machine to determine an accurately adjusted position for attachment; and extremely easily setting a desired size of a tolerable deviation range of the practical position of the side edge to the originally expected position of the side edge when the paper web travels.

To achieve the above object, the present invention is provided with an apparatus for modifying a traveling position of a paper web in a paper web processing machine, comprising: a traveling position modification means for modifying a position of a side edge of a paper web traveling toward a processing section in a paper web processing machine; a detection means for detecting the position of the side edge of the paper web; and a control means connected to the modification means and the detection means for controlling the modification means based on a value detected at the detection means. The detection means has a detectable zone with a larger size in a direction parallel to a width of the paper web than a size in the same direction in a tolerable region that allows the side edge of the paper web to be contained, the detectable zone corresponding to an originally expected position of the side edge of the paper web. The control means includes a reference registration means for registering the value detected at the detection means under a predetermined registry condition as a reference value, a detection tolerable range setting means for setting a detection tolerable range of the side edge of the paper web based on the reference value registered by the reference registration means, a detected value comparison means for confirming if the value detected at the detection means falls outside the detection tolerable range set by the detection tolerable range setting means, and a modification operating means for operating the modification means if the detected value comparison means confirms that the value detected at the detection means falls outside the detection tolerable range.

In accordance with the apparatus according to the present invention, the detectable zone of the detection means has a larger size in a direction parallel to the width of the paper web than a size in the same direction in a tolerable region that allows the side edge of the paper web to be contained. The detectable zone is provided corresponding to the originally expected position of the side edge of the paper web. Within the detectable zone, the value detected at the detection means under a pre-determined registry condition as a reference value is registered and a detection tolerable range of the side edge of the paper web is set based on the reference value. Therefore, the apparatus is capable of permitting a deviation of a position for attaching the detection means; attaching it extremely easily by anyone without any experience and skill; requiring no operation of the paper web processing machine to determine the position for attachment through an accurate adjustment; and greatly improving the work efficiency of the attachment.

In the paper web processing machine equipped with the apparatus according to the present invention, after the running of the machine begins, the paper web is drawn out of the web mounted on the mounting machine. Then, the paper web passes through the position corresponding to the detectable zone of the detection means, and travels toward the processing section, where it is processed. After the running of the paper web processing machine begins, the detection means detects the side edge of the traveling paper web to start outputting detected values. A detected value output from the detection means differs from another based on a position within the detectable zone where the side edge of the paper web is detected. The control means registers the value detected at the detection means as a reference value under a given registry condition, for example, when the running speed of the paper web processing machine reaches a pre-determined speed.

After completion of the registration of the reference value, the control means compares the detected value output from the detection means with the registered reference value. D uring the comparison, the control means sets the detection tolerable range based on the reference value and confirms if the detected value output from the detection means is contained within the detection tolerable range.

As a result of the comparison of the detected value thus performed, if the detected value is not contained within the detection tolerable range, the control means outputs a signal for operating the traveling position modification means to modify the sheet traveling position to be contained within the detection tolerable range. Then, the traveling position modification means operates based on the signal output from the control means to modify the sheet traveling position so that the side edge of the traveling sheet moves to an appropriate position and the detected value from the detection means is contained within the detection tolerable range. During the modification, the control means continues the comparison until the detected value from the detection means is contained within the detection tolerable range.

In the apparatus according to the present invention, preferably, the detection means including: a projection means for projecting a light beam having a size at least equal to a length of the detectable zone in a direction parallel to the width of the paper web; and a photosensitive means having a photosensitive zone for receiving the light beam, the photosensitive zone having a size at least equal to the length of the detectable zone in a direction parallel to the width of the paper web the projection means and the photosensitive means are located at opposite positions sandwiching the originally expected position of the side edge of the sheet, and wherein the control means is connected at least to the photosensitive means. According to such the arrangement, the paper web located between the projection means and the photosensitive means blocks a part of the light beam output from the projection means and varies the area of the part of the photosensitive means effective to receive light based on the position of the side edge of the paper web. Therefore, a detected value can be obtained based on the electric signal output in proportional to the variation, for example.

In the apparatus according to the present invention, preferably, the detection tolerable range setting means is designed to set the detection tolerable range of the side edge of the sheet based on a tolerance value previously registered and the reference value registered by the reference registration means. Preferably, control means is connected to an input means to input the tolerance value, and is designed to register the tolerance value input from the input means as the tolerance value previously registered. In this case, if a tolerance value is newly input from the input means, the tolerance value previously registered is updated for the tolerance value newly input.

In the apparatus according to the present invention, preferably, the control means is connected to a running speed signal output means for outputting a running speed signal of the paper web processing machine, and wherein the reference registration means is designed to register a detected result from the detection means at the time, when a running speed based on the running speed signal output from the running speed signal output means reaches a pre-determined speed, as the reference value. Preferably, the control means is connected to a manual modification signal output means for outputting a manual modification signal when the position in the width of the paper web is manually modified, and wherein the reference registration means is designed to register a detected result from the detection means at the time, when the manual modification signal output from the manual modification signal output means halts, as the reference value.

Preferably, the control means is connected to a paper joint signal output means for outputting a paper joint signal when a paper joint of the paper web processing machine is performed, and wherein the detected value comparison means is designed to receive the paper joint signal from the paper joint signal output means to perform the comparison. Preferably, the control means including: a register section containing the reference registration means; a comparator section containing the detection tolerable range setting means and the detected value comparison means; and an operation signal output section containing the modification activating means.

BRIEF DESCRIPTION OF THE DRAWINGS

The present invention will be more fully understood from the following detailed description with reference to the accompanying drawings, in which.

DETAILED DESCRIPTION OF THE PREFERRED EMBODIMENTS

Figure 1:
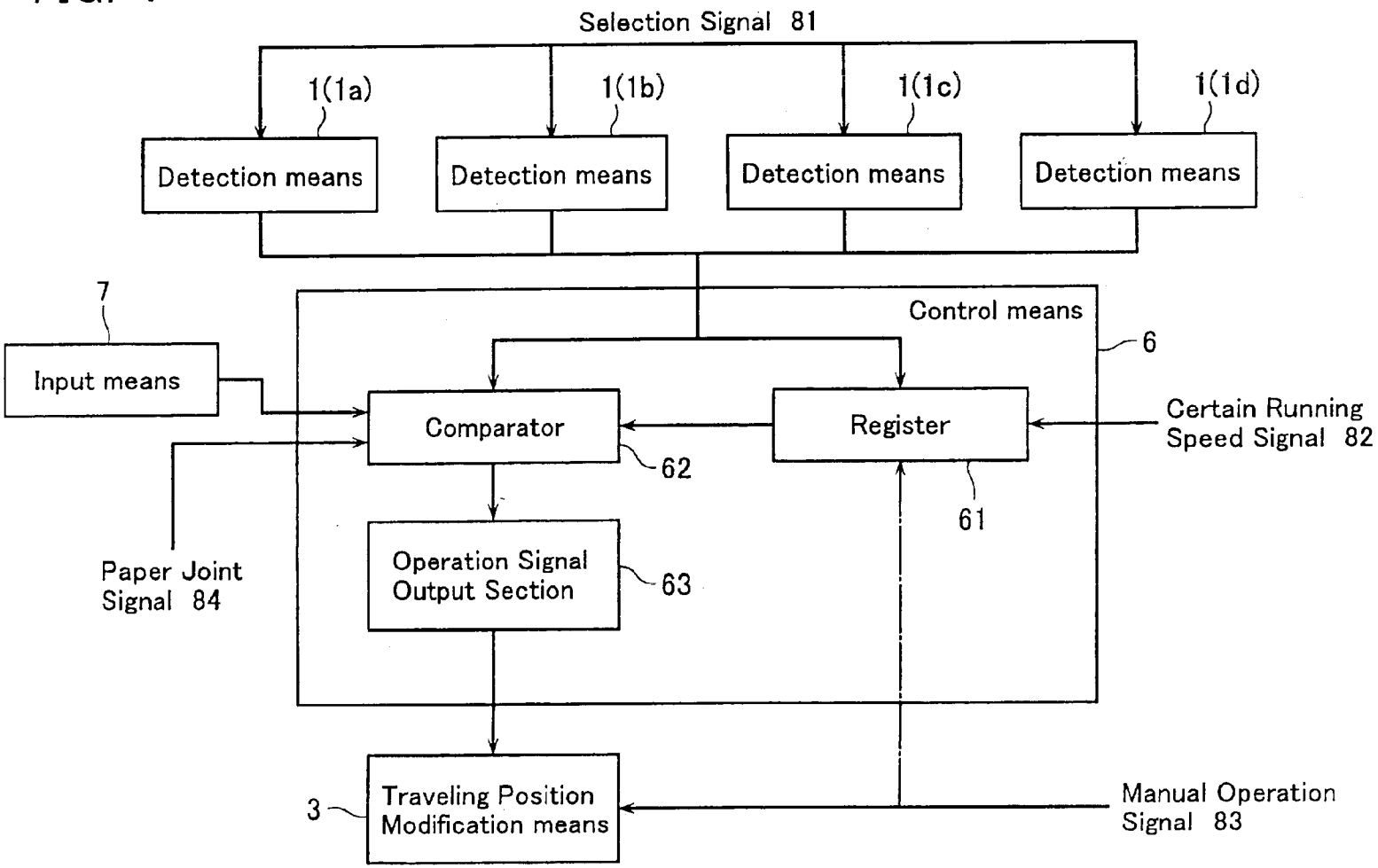
FIG. 1 is a brief block diagram of an apparatus for modifying a traveling position of a paper web according to an embodiment.
Figure 2:
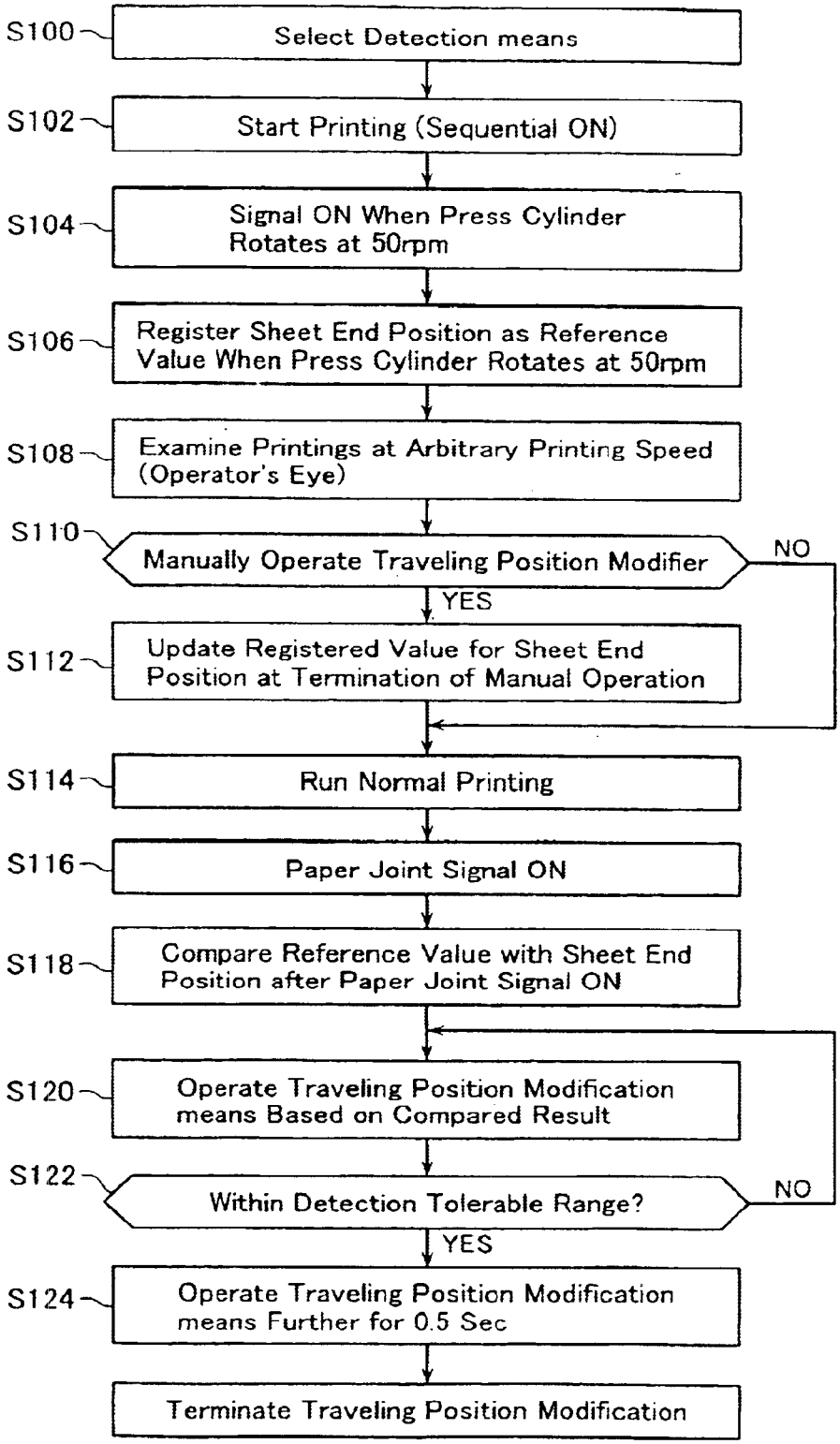
FIG. 2 is a flowchart showing operations of the apparatus for modifying the traveling position of the paper web according to the embodiment.
Figure 3:
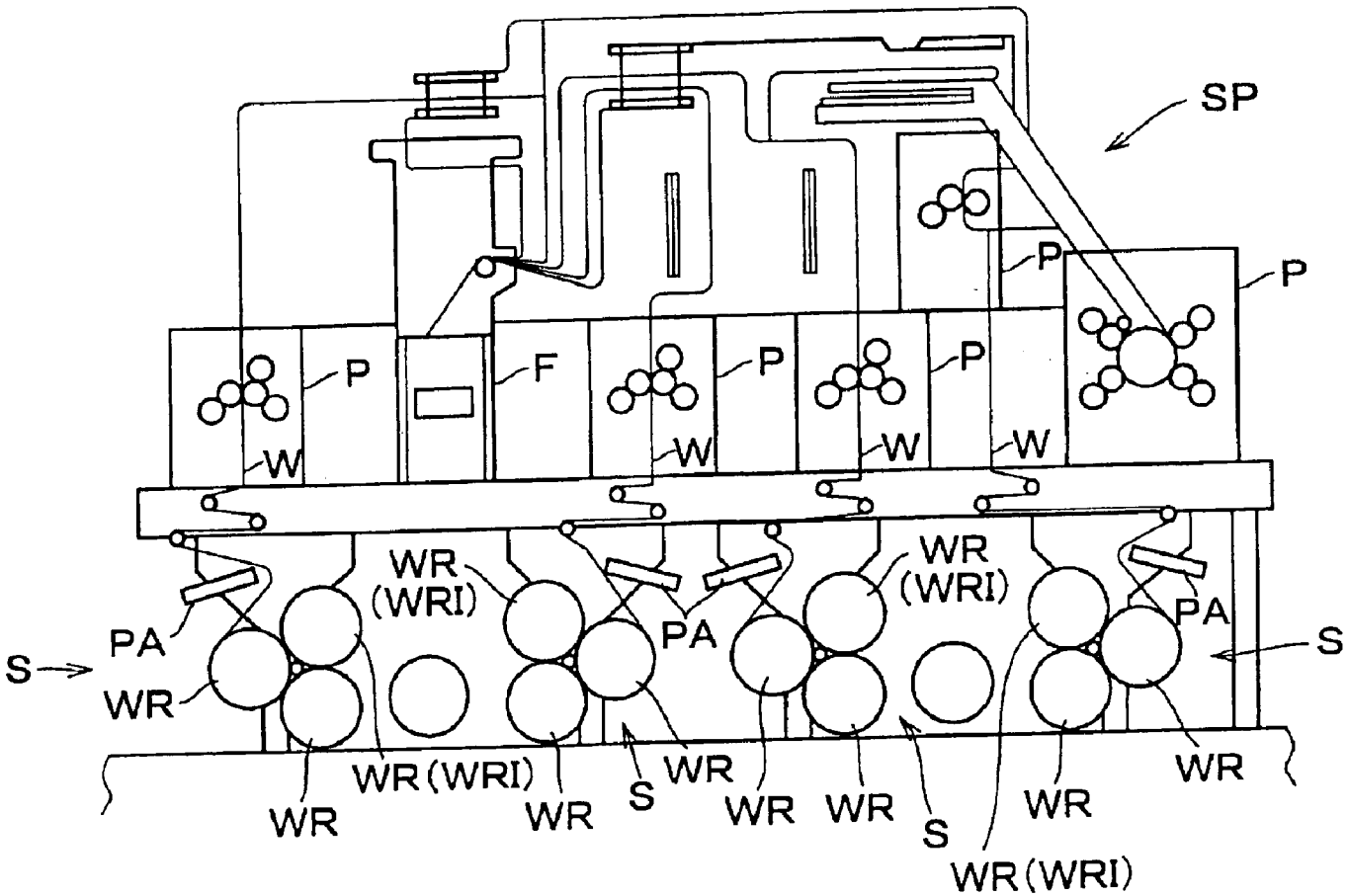
FIG. 3 is a brief arrangement diagram of a newspaper rotary press that is a paper web processing machine including the apparatus for modifying the traveling position of the paper web according to the embodiment mounted thereon.
Figure 4:
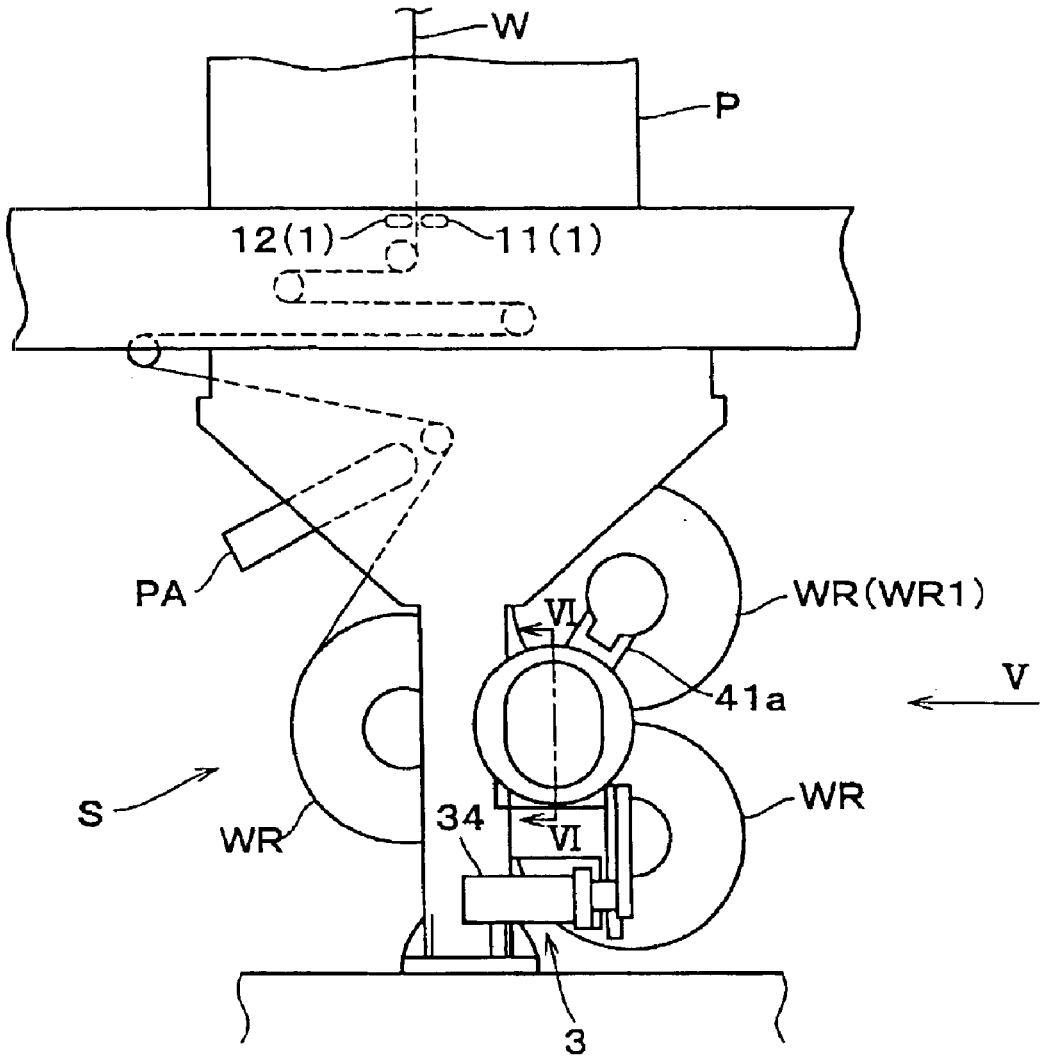
FIG. 4 is a brief front view of a paper feeder in the newspaper rotary press shown in FIG. 3.
Figure 5:
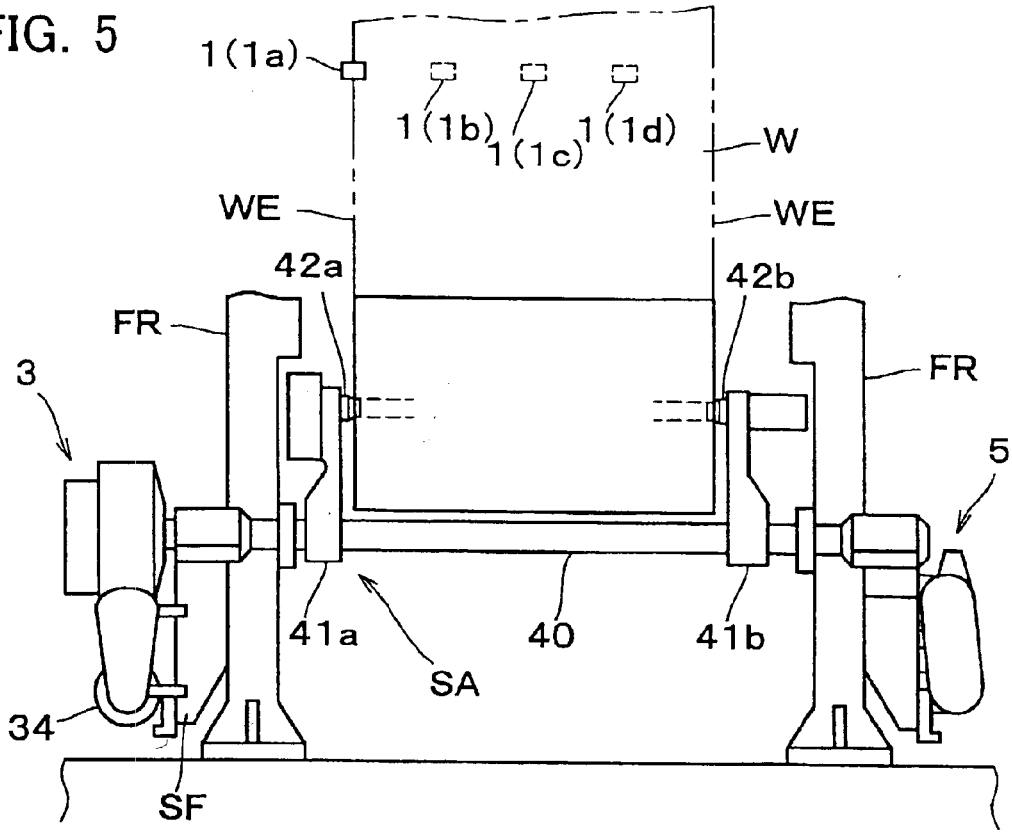
FIG. 5 is a view partly omitted and seen from the arrow-headed direction V in FIG. 4.
Figure 6:
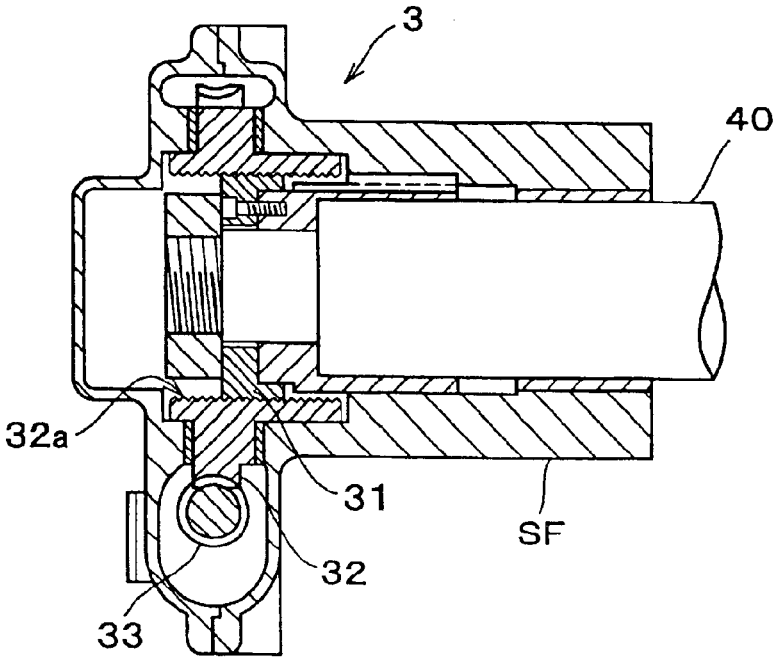
FIG. 6 is a cross-sectional view partly omitted and seen from the arrow-headed direction VI—VI in FIG. 4.
Figure 7:
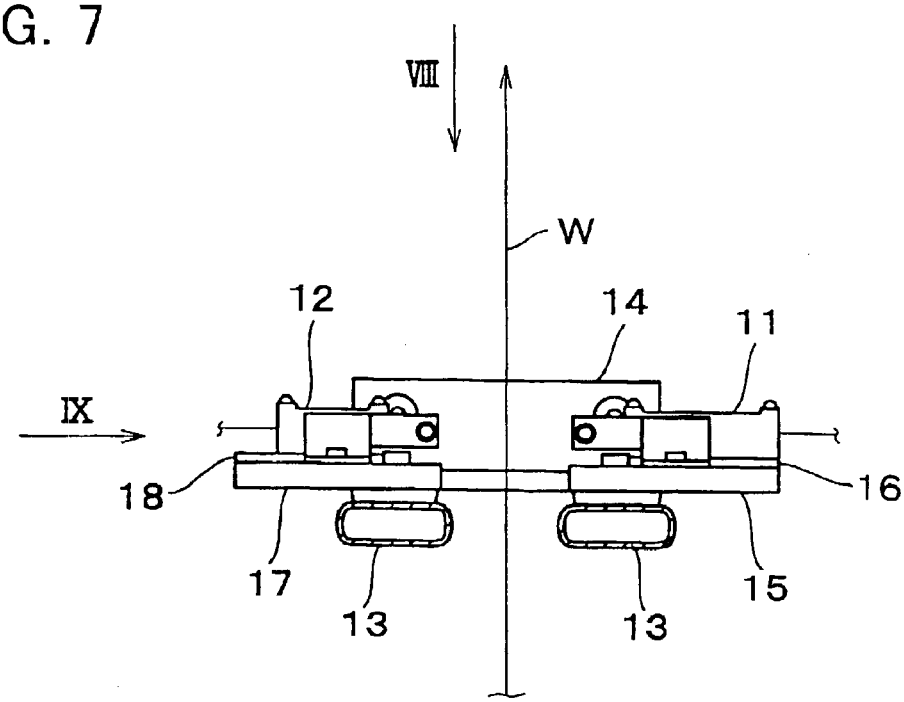
FIG. 7 is a cross-sectional front view showing the attached state of the detection means shown in FIG. 4.
Figure 8:
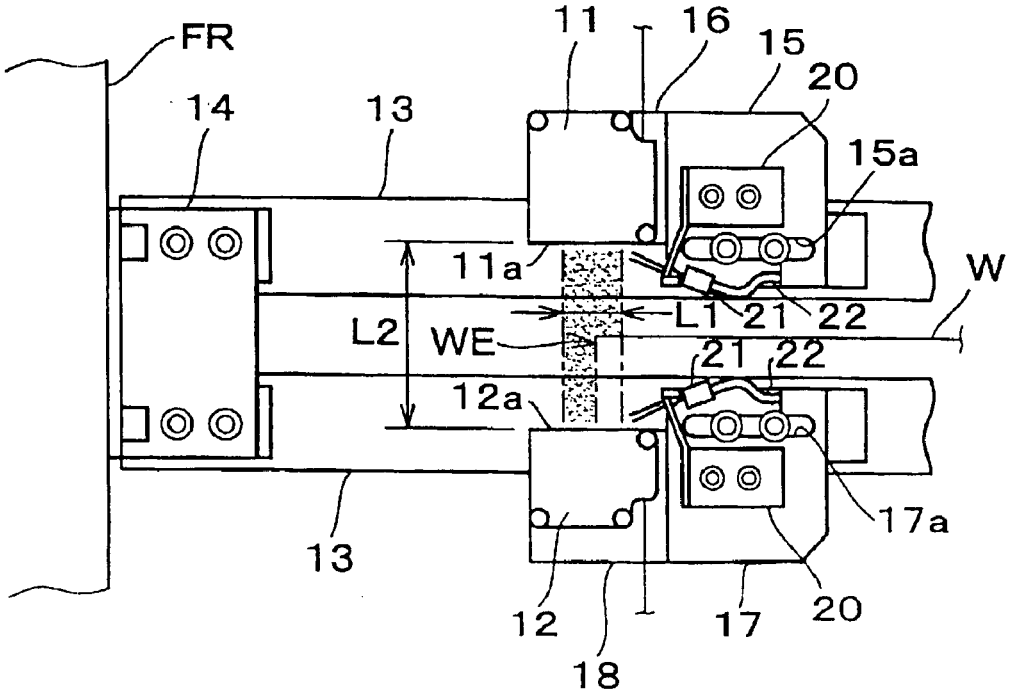
FIG. 8 is a view partly omitted and seen from the arrow-headed direction VIII in FIG. 7.
Figure 9:
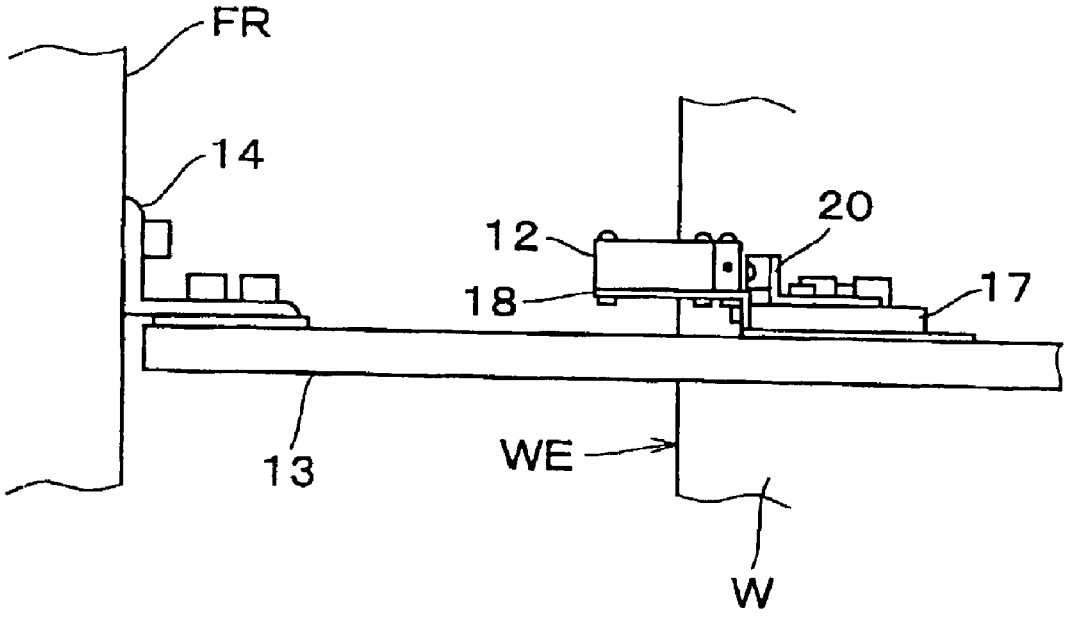
FIG. 9 is a view partly omitted and seen from the arrow-headed direction IX in FIG. 7.
Figure 10:
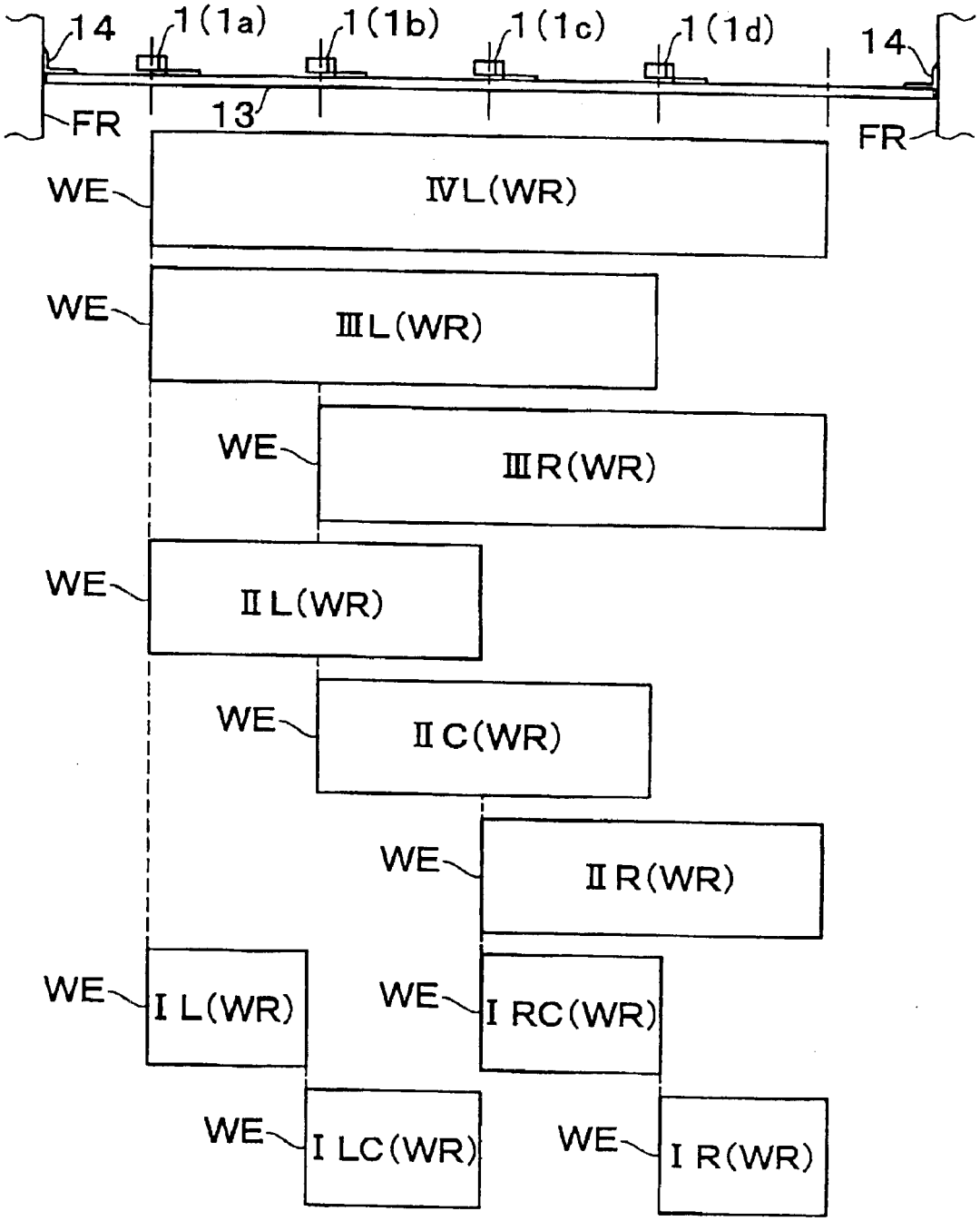
FIG. 10 illustrates an example of installation of detection means applied to the newspaper rotary press shown in FIG. 3 associated with the widths and the attached positions of the webs for use in the rotary press.

An embodiment of the apparatus for modifying the traveling position of the paper web according to the present invention will be described next with reference to the drawings. FIG. 1 is a brief block diagram of an apparatus for modifying a traveling position of a paper web according to the embodiment; FIG. 2 is a flowchart showing operations of the apparatus for modifying the traveling position of the paper web according to the embodiment; FIG. 3 is a brief arrangement diagram of a newspaper rotary press that is a paper web processing machine including the apparatus for modifying the traveling position of the paper web according to the embodiment mounted thereon; FIG. 4 is a brief front view of a paper feeder in the newspaper rotary press shown in FIG. 3; FIG. 5 is a view partly omitted and seen from the arrow-headed direction V in FIG. 4; FIG. 6 is a cross-sectional view partly omitted and seen from the arrow-headed direction VI—VI in FIG. 4; FIG. 7 is a cross-sectional front view showing the attached state of the detection means shown in FIG. 4; FIG. 8 is a view partly omitted and seen from the arrow-headed direction VIII in FIG. 7; FIG. 9 is a view partly omitted and seen from the arrow-headed direction IX in FIG. 7; and FIG. 10 illustrates an example of installation of detection means applied to the newspaper rotary press shown in FIG. 3 associated with the widths and the attached positions of the webs for use in the rotary press.

As shown in FIG. 1, the apparatus for modifying the traveling position of the paper web according to the embodiment comprises a detection means 1 for detecting the position of a side edge WE (see FIG. 5) of a traveling paper web W (see FIG. 5), a traveling position modification means 3 for modifying the position of the side edge WE of the traveling paper web W, and a control means 6 for controlling the modification means 3 based on a value detected at the detection means 1, for example. This apparatus for modifying the position is provided, for example, in a newspaper rotary press SP that is a paper web processing machine as shown in FIG. 3. In FIG. 3, S denotes a paper feeder. The paper feeder S comprises a web mounting device SA (see FIGS. 4 and 5, described later in detail) employed for mounting a rolled web WR thereon and a paper joint device PA employed for jointing a web WR1 on standby to the traveling sheet before it is fully consumed. A paper web W, which travels toward a processing section consisting of a printing section P and a folding section F, is drawn out from the web.

As shown in FIG. 1, the detection means 1 is connected to a control means 6. Where a plurality of detection means 1 are provided to respond to variations in the width and mounting position of the web WR as described later, one of the plurality of detection means 1 is selected and designated for running based on a selection signal 81 received from a selection/designation means (not depicted).

The detection means 1 includes a projection means 11 and a photosensitive means 12 corresponding to the projection means 11 as shown in FIGS. 4, 7 and 8. The projection means 11 includes a light beam output portion 11*a* that can output a belt-shaped parallel laser of visible light with an appropriate width of L1 (for example, approximately 30 mm). The width L1 of the parallel laser of visible light is designed to be sufficiently larger than a size of a tolerable region in the same direction, within which the side edge of the traveling sheet should be contained. The photosensitive means 12 has a photodetector 12*a* consisting of a CCD line sensor with a length almost same as the width L1 of the parallel laser of visible light to receive the parallel laser of visible light output from the projection means 11. The CCD line sensor outputs an electric signal with a magnitude proportional to the dimension of a photosensitive zone for receiving the parallel laser of visible light (length or area of the photosensitive part). Transparent covers are applied on the beam output portion 11*a* and the photodetector 12*a*, respectively. A s obvious from the action of detection, the width L1 of the belt-shaped parallel laser of visible light strip output from the projection means 11 is not required to match the length of the CCD line sensor in the photosensitive means 12 for receiving the parallel laser of visible light. With respect to the zone for emitting the belt-shaped parallel laser of visible light strip and the photosensitive zone on the CCD line sensor, if at least one of them has a size sufficiently larger than that in the same direction of the tolerable region, within which the side edge of the traveling sheet should be contained, the other may have a size above that.

As shown in FIGS. 7–9, on stays 13, 13 that sandwich a traveling path of the paper web W and are located parallel to the width of the paper web W traveling in the path, the projection means 11 and the photosensitive means 12 are provided respectively through brackets 15, 17, spacing an appropriate gap L2 from and opposing to each other. The projection means 11 is positioned so that the center of the width L1 of the parallel laser of visible light output therefrom almost matches the originally expected position of the side edge WE of the traveling paper web W. The photosensitive means 12 is positioned so that the center of the length of the CCD line sensor almost matches the originally expected position of the side edge WE of the traveling paper web W. Both ends of the stays 13, 13 are attached through a bracket 14 respectively to frames FR (only one of them is depicted), which sandwich the paper web W therebetween and are provided perpendicular to the width of the paper web W traveling in the path, opposing to each other. The brackets 15 and 17 have ellipses 15*a*, 17*a* formed in parallel with the stays 13, 13. The brackets 15 and 17 are attached to the stays 13, 13 movably in the longitudinal direction by means of bolts inserted into the ellipses 15*a*, 17*a*. By moving the brackets 15 and 17 are moved to adjust a position, the zone for emitting the belt-shaped parallel laser of visible light strip can be opposed to the photosensitive zone on the CCD line sensor without waste.

Where the paper web processing machine such as the newspaper rotary press SP has a plurality of types in the width of the paper web W (or web WR) to be employed and a plurality of positions for mounting webs WR between the frames FR, FR, a plurality of the detection means 1 are provided along the width of the traveling path of the paper web W. Each of the plurality of the detection means 1 is provided corresponding to the position of the side edge WE of the traveling paper web W, which varies based on the type and mounting position of the web WR employed in the corresponding paper web processing machine. In the apparatus for modifying the traveling position of the paper web according to the embodiment, as shown in FIGS. 5 and 10, webs WR having widths of 4-page newspaper, 3-page newspaper, 2-page newspaper and 1-page newspaper are used. The 4-page newspaper wide web WR is mounted only on a single position indicated by IVL. The 3-page newspaper wide webs WR are mounted on two positions indicated by IIIL and IIIR; the 2-page newspaper wide webs WR on three positions indicated by IIL, IIC and IIR; and the 1-page newspaper wide webs WR on four positions indicated by IL, ILC, IRC and IR. There are four detection means 1*a*, 1*b*, 1*c* and 1*d* located between the frames FR, FR. The detection means 1*a* is provided to detect the left side end of the traveling paper web W drawn from each of the webs WR at the mounting positions IVL, IIIL, IIL and IL. The detection means 1*b* is provided to detect the left side end of the traveling paper web W drawn from each of the webs WR at the mounting positions IIIR, IIC and ILC. The detection means 1*c* is provided to detect the left side end of the traveling paper web W drawn from each of the webs WR at the mounting positions IIR and IRC. The detection means 1*d* is provided to detect the left side end of the traveling paper web W drawn from the web WR at the mounting position IR.

As shown in FIG. 8, air blowers 21 are attached through a bracket 20 to the brackets 15 and 17. The air blowers 21 have air blow apertures directed to the transparent cover on the beam output section 11*a* and the transparent cover on the photodetector 12*a*, respectively. The bases of the air blowers 21 are connected to an air source, not depicted, through pipes 22 each equipped with an open/close valve, not depicted. The air blowers 21 are employed to blow air from the air blow apertures to effectively remove dust such as paper dust attached to the transparent covers on the beam output section 11*a* or the photodetector 12*a*. As described above, as the CCD line sensor outputs an electric signal with a magnitude proportional to the dimension of a photosensitive zone (length or area of the photosensitive part), by grasping a condition of the electric signal output from the CCD line sensor in the absence of the paper web W and dust, and, prior to printing, confirming a condition of the electric signal output from the CCD line sensor in the absence of the paper web W, it is possible to easily identify if dust such as paper dust is attached to the transparent covers on the beam output section 11*a* and the photodetector 12*a*.

The traveling position modification means 3 is provided in the web mounting device SA in the paper feeder S (see FIGS. 4 and 5) that supports the web WR rotatably. According to the apparatus for modifying the traveling position of the paper web of the embodiment, the traveling position modification means 3 includes a mechanism for shifting the web WR, which is provided in the paper feeder S, in a direction along the width thereof.

As shown in FIGS. 4 and 5, the web mounting device SA comprises frames FR, FR opposing to each other, an arm shaft 40 supported rotatably between the frames FR, FR and movably in the axial direction, support arms 41*a*, 41*b* arranged to extend radially from the arm shaft 40 toward equally divided locations on the circumference and oppose to each other, and web support means 42*a*, 42*b* rotatably provided at the tips of the support arms 41*a*, 41*b*, having a common axial line therebetween. The web support means 42*a*, 42*b* are each shaped in the form of an approximately conical trapezoid with a smaller diameter at each of opposite tips than the inner diameter of the core tube in the web WR. A large diameter portion of the conical trapezoid is formed to have a larger diameter than the inner diameter of the core tube in the web WR. One of the web support means 42*a*, 42*b* is secured in parallel with the axial line of the arm shaft 40 and the other is configured movable back and forth in a direction parallel with the axial line of the arm shaft 40. The web support means 42*a*, 42*b* are contained in a mechanism for supporting the web WR, using the secured one as the reference, interposing the web WR strongly between both, pressing the conical trapezoidal outer circumferences against the inner surface of the core tube in the web WR located therebetween. The support arms 41*a*, 41*b* can be moved each to a position along the arm shaft 40 and secured with the arm shaft 40 as one body at the moved position. They can be moved to respond to variations in the width and the mounting position of the web WR.

The web mounting device SA further includes an arm shaft rotating means 5, which rotates the arm shaft 40 together with the support arms 41*a*, 4*b* simultaneously to move the web WR between the sheet drawing-out position and the paper joint position in order to joint the paper web W, before it is fully consumed, to a drawn-out end of a web WR on standby; and the traveling position modification means 3, which moves the arm shaft 40 together with the support arms 41*a*, 41*b* simultaneously in the axial direction to move the web WR in the width direction (in the direction parallel with the axial line of the arm shaft 40) in order to modify the traveling position of the traveling paper web W. The arm shaft rotating means 5 and the traveling position modification means 3 are located outside the frames FR, FR. The traveling position modification means 3 can be run automatically by the control means 6. Alternatively, it can be run by manually operating a traveling position modification means manual operation section at an operation means in a rotary press running controller, not depicted.

The traveling position modification means 3 includes, a s shown in FIG. 6, for example, a male-threaded member 31 secured at the end of the arm shaft 40; a worm wheel 32 having a female-threaded portion 32*a* on the inner surface to mate with the male-threaded member 31 and secured in the axial direction of the arm shaft 40 on a sub-frame SF integrally provided with the frame FR that supports the arm shaft 40; and a worm 33 mating with the worm wheel 32 and connected to a driving source 34.

The traveling position modification means 3 may include a means (not depicted) for directly operating the traveling paper web W drawn out from the web WR to modify the traveling position of the paper web W.

As shown in FIG. 1, the control means 6 includes at least a register 61, a comparator 62 and an operation signal output section 63. The control means 6 is connected to the detection means 1 and the traveling position modification means 3. The control means 6 is also connected to an input means 7, if required. The input means 7 is provided in the paper web processing machine, which is the newspaper rotary press to enter a tolerance value required for setting an expected detection tolerable range of the side edge of the paper web. The control means 6 is further connected to signal output means (not depicted) located in the paper web processing machine to receive the signals consistent with the pre-determined certain registry and comparison conditions therefrom. In the apparatus for modifying the traveling position of the paper web according to the embodiment, as the signal consistent with the comparison condition, a paper joint signa 84 is received, which instructs the paper joint device PA to perform an operation of paper joint.

The register 61 is connected to the detection means 1 and the comparator 62. When the pre-determined registry condition is ready and the signal consistent with the registry condition is received, the register 61 registers the value detected by the detection means 1 at that time as a reference value. After the registration, it can output the reference value to the comparator 62. In the apparatus for modifying the traveling position of the paper web according to the embodiment, as described later, the signal consistent with the registry condition is a certain running speed signal 82 that is received when the running speed of the paper web processing machine, which is the newspaper rotary press reaches a certain speed; or the halt of a manual operation signal 83 that notices the termination of the running when the traveling position modification means 3 is run manually.

The comparator 62 is connected to the detection means 1, the register 61 and the operation signal output section 63. A certain tolerance value for determining the detection tolerable range is registered in the comparator. When a certain comparison condition is ready and the signal coincident with the registry condition is received, the comparator 62 takes in the reference value registered in the register 61. In addition, it takes in a detected value from the detection means 1 that detects a side edge WE of a traveling paper web W drawn out from a new web WR after the paper joint. From the taken reference value and the tolerance value registered in the comparator 62, the comparator 62 derives the maximum and minimum values in the expected detection tolerable range of the side edge WE of the paper web W. The comparator 62 compares the detected value taken from the detection means 1 with the maximum and minimum values in the detection tolerable range to confirm if the detected value falls within the detection tolerable range. In the apparatus for modifying the traveling position of the paper web according to the embodiment, as described above, the signal consistent with the comparison condition is the paper joint signal 84, which instructs the paper joint device PA to perform the operation of paper joint. The comparator 62 outputs a deviation signal to the operation signal output section 63 when the compared result of the detected value falls outside the detection tolerable range determined based on the reference value and the tolerance value. Where the detected value of the detection means 1, which is detecting the side edge WE of the traveling paper web W drawn out from the new web WR after the paper joint, falls outside the detection tolerable range, the comparison of the detected value with the detection tolerable range and the output of the deviation signal are continued until the detected value falls within the detection tolerable range. If the comparator 62 is connected to the input means 7, the tolerance value can be altered, if required.

The operation signal output section 63 is connected to the comparator 62 and the traveling position modification means 3. W hen the deviation signal output from the comparator 62 is received, the operation signal output section 63 outputs an operation signal to the traveling position modification means 3 so that the traveling position modification means 3 is operative to remove the deviation. This operation signal includes information at least on the direction of the deviation occurred or the direction of the deviation to be modified and may include additional information on the magnitude of the deviation. In the apparatus for modifying the traveling position of the paper web according to the embodiment, the operation signal output section 63 includes a clock function that is operated when the comparator 62 terminates the output of the deviation signal. After the output of the deviation signal is terminated, that is, after the detected value falls within the detection tolerable range, the operation signal output section 63 outputs an operation signal for modifying the deviation in the same direction continuously during a predetermined period of time, for example, 0.5 second while the clock function operates.

When the operation signal output from the operation signal output section 63 is received, the traveling position modification means 3 is designed to operate the driving source 34.

Operations of the apparatus for modifying the traveling position of the paper web according to the embodiment will be described next. An appropriate means, such as the operation means of the rotary press running controller for running the rotary press, which is the paper web processing machine, is operated first to output the selection signal 81 to select the detection means 1 matching with the width of the web WR (that is, the width of the paper web W) to be employed in the running of the rotary press. In this embodiment, the detection means 1*a* is selected (S100). W hen the rotary press is started running in a paper fed state, the paper web W is drawn out from the web WR mounted on the web mounting device SA. The paper web W then passes a position corresponding to the detectable zone of the detection means 1, that is, a position between the projection means 11 and the photosensitive means 12, which cuts a part of the width of the parallel laser of visible light output from the projection means 11 off to the CCD line sensor in the photosensitive means 12. The paper web W travels toward the processing section including a printing section P that performs printing and a folding section F that performs cutting and folding (S102).

The position of the web W mounted on the web mounting device SA may often be deviated slightly in the axial direction due to the following reason. As described above, when the conical trapezoidal web support means 42*a*, 42*b* are inserted into the core tube of the web WR from both sides, the web WR is supported between the web support means 42*a*, 42*b*, using one of the web support means 42*a*, 42*b* as the reference and the other for pressing the core tube strongly. The inner diameter of the core tube differs slightly from one another. If an inner diameter of the core tube is smaller, the mounting position of the web WR may displace closer to the other side of the web support means 42*a*, 42*b*. If an inner diameter of the core tube is larger, the mounting position of the web WR may displace closer to the one side of the web support means 42*a*, 42*b*. The support arms 41*a*, 41*b* equipped with the web support means 42*a*, 42*b* may be shifted in the axial direction of the arm shaft 40 to be matched with the width and mounting position of the web WR to be mounted, as described above. As a result of a slight difference in fixed positions after the movement, the mounting position of the web WR may be shifted in the axial direction of the arm shaft 40.

The paper web W drawn out from the web WR in such the deviated state may be forced to travel while its side edge WE is deviated from the originally expected position even though it is several millimeters at most.

In the paper web processing machine such as the newspaper rotary press that piles a plurality of paper webs W, an uneven pile may often be resulted from the difference in the deviated direction and magnitude of each paper web W.

After the rotary press starts running in such the state, the detection means 1 detects the position of the side edge WE of the traveling paper web W based on a condition of the parallel laser of visible light blocked by the paper web W. The detection means 1 detects the width of the parallel laser of visible light, which varies in response to the position of the side edge WE of the paper web W passing, by the length (or area) of the photosensitive zone on the CCD line sensor for receiving the parallel laser of visible light. The detection means 1 outputs an electric signal with a magnitude proportional to the width as a detected value.

When the rotary press is gradually accelerated through a sequential control, the running speed of the rotary press reaches a pre-determined certain speed, for example, the number of revolutions of a press cylinder in the printing section P reaches 50 rpm (S104). When a running speed signal output section (not depicted) in the rotary press outputs an electric signal in response to the speed, the control means 6 receives the speed signal as the certain running speed signal 82 and starts running. The control means 6 also takes in the detected value from the detection means 1 at this point in time to register it as the reference value in the register 61 (S106).

The rotary press further accelerates while the control means 6 registers the reference value in the register 61. It temporarily halts to accelerate at the pre-determined running speed that achieves a stable printing state to eject printings to a certain position for ejecting. The printings are employed by the operator to examine a printed state and a piled state of a plurality of paper webs W, . . . , W. The ejected printings are immediately examined by the operator (S108). If the pile of the plurality of paper webs W, . . . , W is disturbed due to the deviation of the traveling position of any one of the paper webs W, the traveling position modification means manual operation section at the operation means in the rotary press running controller, not depicted, is manually operated. This manual operation is effective to operate the traveling position modification means 3 in the web mounting device SA employed for mounting the web WR thereon, from which the paper web W with the deviated traveling position is drawn out, and to move the arm shaft 40 and the support arms 41*a*, 41*b* in the web mounting device SA in the axial direction of the arm shaft 40 to modify the deviation of the paper web W and arrange the piled state of the plurality of paper webs W, . . . , W (S110). During this manual modification, through the manual operation of the traveling position modification means manual operation section, the manual operation signal 83 output from the rotary press controller is employed to operate the driving source 34 for the traveling position modification means 3. The signal is also fed into the register 61 in the control means 6. Every time the input of the manual operation signal 83 halts, the register 61 registers the detected value output from the detection means 1 at the time when the input of the manual operation signal 83 halts, as a new reference value, instead of the reference value previously registered (S112).

With respect to the paper web W drawn out from the web WR mounted on the web mounting device SA that is not modified manually, as the reference value registered in the register 61 of the control means 6, the reference value registered at the time, when the certain running speed signal 83 is output is held as it is.

When the modification by the manual operation is completed, the registration of the reference value is also completed and the modification of the traveling position of the traveling paper web W is completed. When the operator operates the operation means in the rotary press running controller, the rotary press is accelerated to the pre-determined speed, then it is normally run at that speed, through the sequential control (S114).

When the web WR is gradually consumed during the normal running and the rest reaches a certain amount, the rotary press comes into a paper joint mode for jointing the present traveling paper web W to the drawn-end of another web WR on standby mounted on the web mounting device SA. Based on the signal output from the rotary press running controller, the arm shaft rotating means 5 operates to rotate the arm shaft 40 and the support arms 41*a*, 41*b* counter-clockwise in FIG. 4, for example. In order to joint the traveling paper web W with the drawn-end of the web WR on standby, the outer circumference of the web WR is moved to the paper joint position close to the traveling paper web W in the vicinity of the paper joint device PA. After completion of the movement, at a pre-determined point in time, for example, when the outer diameter of the web WR, from which the present traveling paper web W is drawn out, reaches a pre-determined size, the rotary press running controller outputs the paper joint signal 84 for instructing the paper joint. Then, the paper joint is performed.

The paper joint signal 84 output from the rotary press running controller is employed in the paper joint device PA to perform the operation of paper joint and is fed into the comparator 62 in the control means 6 (S116).

The comparator 62, into which the paper joint signal 84 is fed, takes in the reference value registered in the register 61, and takes in the detected value from the detection means 1 that detects the side edge WE of the traveling paper web W drawn out from the new web WR after the paper joint. The comparator 62 derives the maximum and minimum values of the detection tolerable range from the taken reference value and the reference value registered in the register 61. It compares the detected value taken from the detection means 1 with the maximum and minimum values of the detection tolerable range to confirm if the detected value falls within the detection tolerable range (S118). If the detected value is not contained within the detection tolerable range, the comparator 62 outputs the deviation signal to the operation signal output section 63. If the detected value of the detection means 1, which is detecting the side edge WE of the traveling paper web W drawn out from the new web WR after the paper joint, falls outside the detection tolerable range, the comparison of the detected value with the detection tolerable range and the output of the deviation signal are continued until the detected value falls within the detection tolerable range.

When the operation signal output section 63 receives the deviation signal from the comparator 62, it outputs an operation signal that operates the traveling position modification means 3 to remove the deviation of the traveling position of the paper web W drawn out from the new web WR after the paper joint. In the illustrated embodiment, the operation signal output section 63 starts the clock function immediately after the deviation signal output from the comparator 62 is terminated. After the termination of the deviation signal output, that is, the detected value falls within the detection tolerable range, the operation signal output section 63 continuously outputs an operation signal that subsequently operates the traveling position modification means 3 similarly during a pre-determined period of time, for example, 0.5 second while the clock function operates.

The operation signal output from the operation signal output section 63 is employed to operate the driving source 34 for the traveling position modification means 3. The driving source 34 is rotated in the rotational direction that is determined based on the information, provided to the operation signal, on the direction of the deviation occurred or deviation to be modified.

In the traveling position modification means 3, when the driving source 34 rotates, the worm 33 coupled to the spindle of the driving source 34 also rotates, and is mated with the worm 33, rotating the worm wheel 32, which is secured to the sub-frame SF integrated with the frame FR in the axial direction of the arm shaft 40. When the worm wheel 32 is rotated, the male-threaded member 31 mated with the female-threaded portion 32*a* of the worm wheel 32 is shifted in the axial direction of the arm shaft 40 relative to the worm wheel 32 through the screw sending action. The male-threaded member 31 is secured in the axial direction and rotatably attached to the arm shaft 40 that is movable in the own axial direction and rotatable relative to the frame FR. As described above, by the movement of the worm wheel 32 relative to the male-threaded member 31, the arm shaft 40 is shifted together with the male-threaded member 31 in the own axial direction relative to the frame FR. Through the arm shaft 40 and the support arms 41*a*, 41*b*, the web WR is shifted in the axial direction of the arm shaft 40 to modify the traveling position of the traveling paper web W drawn out from the web WR (S120).

As a result of the modification, if the detected value of the detection means 1, which is detecting the side edge WE of the traveling paper web W drawn out from the new web WR after the paper joint, falls within the detection tolerable range, the comparator 62 terminates the output of the deviation signal (S122). The operation signal output section 63 starts the clock function immediately after the deviation signal output from the comparator 62 is terminated, and continuously outputs the operation signal subsequently during a pre-determined period of time, for example, 0.5 second while the clock function operates. As a result of the operation signal continuously output for 0.5 second, the operation of traveling position modification means 3 continues for 0.5 second after the termination of the deviation signal output. A s a result, the detected value from the detection means 1, which detects the side edge WE of the traveling paper web W drawn out from the web WR, approaches to the reference value, which is the central value in the detection tolerable range. In a word, the side edge WE of the traveling paper web W drawn out from the web WR approaches to the originally expected position (S124).

Thus, the automatic modification of the traveling position of the side edge WE of the traveling paper web W drawn out from the web WR is completed. After the completion of the automatic modification of the traveling position of the side edge WE of the paper web W, the normal running of the rotary press is continued and the above operations are repeated.

In the above description, the comparison condition under which the comparator 62 performs the comparison operation is the paper joint operation after the registration of the reference value. This is because the mounting position of the web WR may possibly be shifted in the axial direction of the arm shaft 40 due to the difference in the inner diameter of the core tube, as described above, and the traveling position of the side edge WE of the traveling paper web W may be deviated with a large possibility. The comparison condition is not limited to the paper joint operation. For example, it may be continued during the stable running of the rotary press. If the comparator 62 continues the comparison operation always during the stable running of the rotary press, the comparison condition, under which the comparison operation is performed, is the running speed of the rotary press higher than a speed that ensures the stable running. In this case, a running speed signal (not depicted) is input to the comparator 62 instead of the paper joint signal 82.

In accordance with the apparatus for modifying the traveling position of the paper web according to the present invention, the detectable zone of the detection means has a larger size in a direction parallel to the width of the sheet than a size in the same direction in a tolerable region that allows the side edge of the sheet to be contained. The detectable zone corresponds to the originally expected position of the side edge of the paper web Within the detectable zone, the value detected at the detection means under a given registry condition is registered as a reference value and a detection tolerable range of the side edge of the sheet is set based on the reference value. Therefore, the position modifier is capable of permitting a deviation of a position for attaching the detection means; attaching it extremely easily by anyone without any experience and skill; requiring no operation of the paper web processing machine to determine the position for attachment through an accurate adjustment; and greatly improving the work efficiency of the attachment.

The control means may be connected to the input means to register the tolerance value input from the input means as the tolerance value previously registered. In this case, the practical tolerable range of the side edge relative to the originally expected reference position of the side edge when the sheet travels can be set extremely easily as a desired size of the detection tolerable range. Therefore, after the detection tolerable range is set in response to the required accuracy on the position to be processed in the width, under the running condition including the running speed optimized in response to the required accuracy, the processing running can be performed. As a result, the waste of resources such as sheet and the waste of the running time caused from the failed processing due to the mismatched running condition can be cleared off.

Having described the embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. An apparatus for modifying a traveling position of a paper web in a paper web processing machine, comprising:

a traveling position modification means for modifying a position of a side edge of a paper web traveling toward a processing section in a paper web processing machine;

a detection means for detecting said position of said side edge of said paper web; and a control means connected to said modification means and said detection means for controlling said modification means based on a value detected at said detection means; wherein said detection means has a detectable zone with a larger size in a direction parallel to a width of said paper web than a tolerable region that allows said side edge of said paper web to be contained, said detectable zone corresponding to an originally expected position of said side edge of said paper web; said control means comprises a reference registration means for registering said value detected at said detection means as a reference value, when the paper web processing machine starts running and has its running speed reach a pre-determined certain speed, a detection tolerable range setting means for setting a detection tolerable range of said side edge of said paper web based on said reference value registered by said reference registration means, a detected value comparison means for confirming if said value detected at said detection means falls outside said detection tolerable range set by said detection tolerable range setting means, and a modification operating means for operating said modification means if said detected value comparison means confirms that said value detected at said detection means falls outside said detection tolerable range.

2. The apparatus according to claim 1, said detection means comprising a projection means for projecting a light beam having a size at least equal to a length of said detectable zone in a direction parallel to said width of said paper web; and a photosensitive means having a photosensitive zone for receiving said light beam, said photosensitive zone having a size at least equal to said length of said delectable zone in a direction parallel to said width of said paper web.

3. The apparatus according to claim 2, wherein said projection means and said photosensitive means are located at opposite positions sandwiching said originally expected position of said side edge of said sheet, and wherein said control means is connected at least to said photosensitive means.

4. The apparatus according to claim 1, wherein said detection tolerable range setting means is designed to set said detection tolerable range of said side edge of said sheet based on a tolerance value previously registered and said reference value registered by said reference registration means.

5. The apparatus according to claim 4, wherein said control means is connected to an input means to input said tolerance value, and is designed to register said tolerance value input from said input means as said tolerance value previously registered.

6. The apparatus according to claim 1, wherein said control means is connected to a running speed signal output means for outputting a running speed signal of said paper web processing machine, and wherein said reference registration means is designed to register a detected result from said detection means at the time, when a running speed based on said running speed signal output from said running speed signal output means reaches a pre-determined speed, as said reference value.

7. The apparatus according to claim 6, wherein said control means is connected to a manual modification signal output means for outputting a manual modification signal when said position in said width of said paper web is manually modified, and wherein said reference registration means is designed to register a detected result from said detection means at the time, when said manual modification signal output from said manual modification signal output means halts, as said reference value.

8. The apparatus according to claim 1, wherein said control means is connected to a paper joint signal output means for outputting a paper joint signal when a paper joint of said paper web processing machine is performed, and wherein said detected value comparison means is designed to receive said paper joint signal from said paper joint signal output means to perform said comparison.

9. The apparatus according to claim 1, said control means including:

a register section containing said reference registration means;

a comparator section containing said detection tolerable range setting means and said detected value comparison means; and an operation signal output section containing said modification activating means.

* * * * *